US006581797B2

(12) United States Patent
McKinney, Jr. et al.

(10) Patent No.: US 6,581,797 B2
(45) Date of Patent: Jun. 24, 2003

(54) PILL DISPENSER WITH REMINDER

(75) Inventors: Edward C. McKinney, Jr., San Rafael, CA (US); Tristan M. Christianson, San Francisco, CA (US); Richard J. Thalheimer, San Francisco, CA (US); Jesse F. Patterson, San Rafael, CA (US)

(73) Assignee: Sharper Image Corporation, San Francisco, CA (US)

( * ) Notice: Subject to any disclaimer, the term of this patent is extended or adjusted under 35 U.S.C. 154(b) by 0 days.

(21) Appl. No.: 09/882,901

(22) Filed: Jun. 15, 2001

(65) Prior Publication Data

US 2003/0006242 A1 Jan. 9, 2003

(51) Int. Cl.[7] ..... G07F 11/00
(52) U.S. Cl. ..... 221/7; 221/84

(58) Field of Search ..... 221/2, 3, 7, 8, 221/13, 15, 76, 82, 84, 85; 368/10

(56) References Cited

U.S. PATENT DOCUMENTS 1,823,093 A * 9/1931 Du Grenier ..... 221/84
2,696,326 A * 12/1954 Clem ..... 221/84
3,616,965 A * 11/1971 Bendl ..... 221/84

* cited by examiner

*Primary Examiner*—Kenneth W. Noland
(74) *Attorney, Agent, or Firm*—Fliesler, Dubb, Meyer & Lovejoy LLP

(57) ABSTRACT

A programmable vitamin and pill dispenser that is capable of storing multiple pill groups. The dispenser provides reminders to an individual when it is time to ingest the next serving. The serving is dispensed into a cup upon depressing a dispenser button. By loading the individual compartments specific to each serving, an individual does not have to create the serving each time.

29 Claims, 5 Drawing Sheets

PILL DISPENSER WITH REMINDER

FIELD OF THE INVENTION

The present invention relates generally to a vitamin and pill dispensing device. More particularly, this present invention pertains to a device that can be programmed to automatically alert a user when it is time to take the next pill.

BACKGROUND

The use of vitamins and pills has increased significantly in the past years. With this increase in use, there has grown a need to have a pill storage device which may be conveniently used by an individual as a dispenser of pills. Particularly, the individual may be using several different vitamins or pills, requiring a multi-compartment device that is easy to use at home. A central requisite of a pill dispenser is the ability for convenient pill filling and dispensing.

Pill dispensing mechanisms have been commercially available for many years. Typically, a dispensing mechanism comprises a box having dosage compartments and indicia indicating what dosage should be taken on a particular day. However, the user is still dependent on his/her memory to open the correct compartment, at the appropriate dosage time. Thus these devices are not convenient for use.

SUMMARY OF THE INVENTION

What would be desired is to provide an automatic dosage dispenser device where the user is alerted up to a number of times daily, via, by way of example only, an audible alarm or visual alarm that a proper dose is available for ingestion. In this respect, the vitamin and pill dispensing device according to the present invention substantially departs from the conventional concepts and designs of the prior art.

Therefore, it can be appreciated that there exists a continued need for a new and improved vitamin and pill dispensing device which can be used for dispensing a predetermined quantity of vitamins and pills. In this regard, the present invention substantially fulfills the need.

It is an object of the present invention to provide a vitamin and pill dispensing device that has multiple compartments for storing pill groups. The multiple compartments provides an individual with the ability to store several servings for dispensing over a multiple hour or multiple day period.

It is yet another object of the present invention to dispense each pill group into a removable pill container so that the user can easily ingest each serving.

Another object of the present invention is for an individual to have the ability to program the dispensing unit to automatically dispense and/or provide a reminder when to take the vitamin or pill.

DETAILED DESCRIPTION OF THE INVENTION

Figure 1:
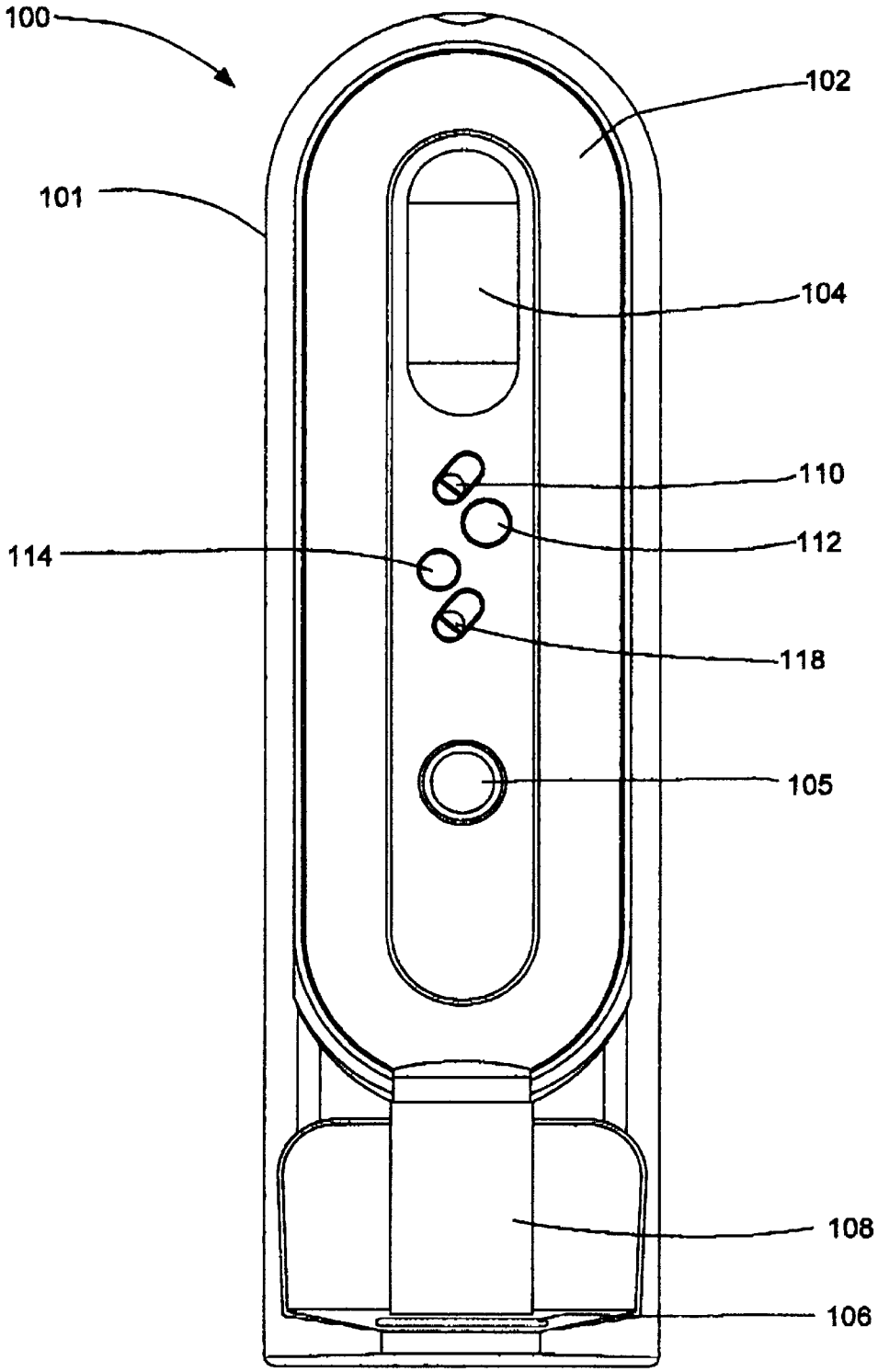
FIG. 1 is a front view of an embodiment of the present invention.
Figure 2:
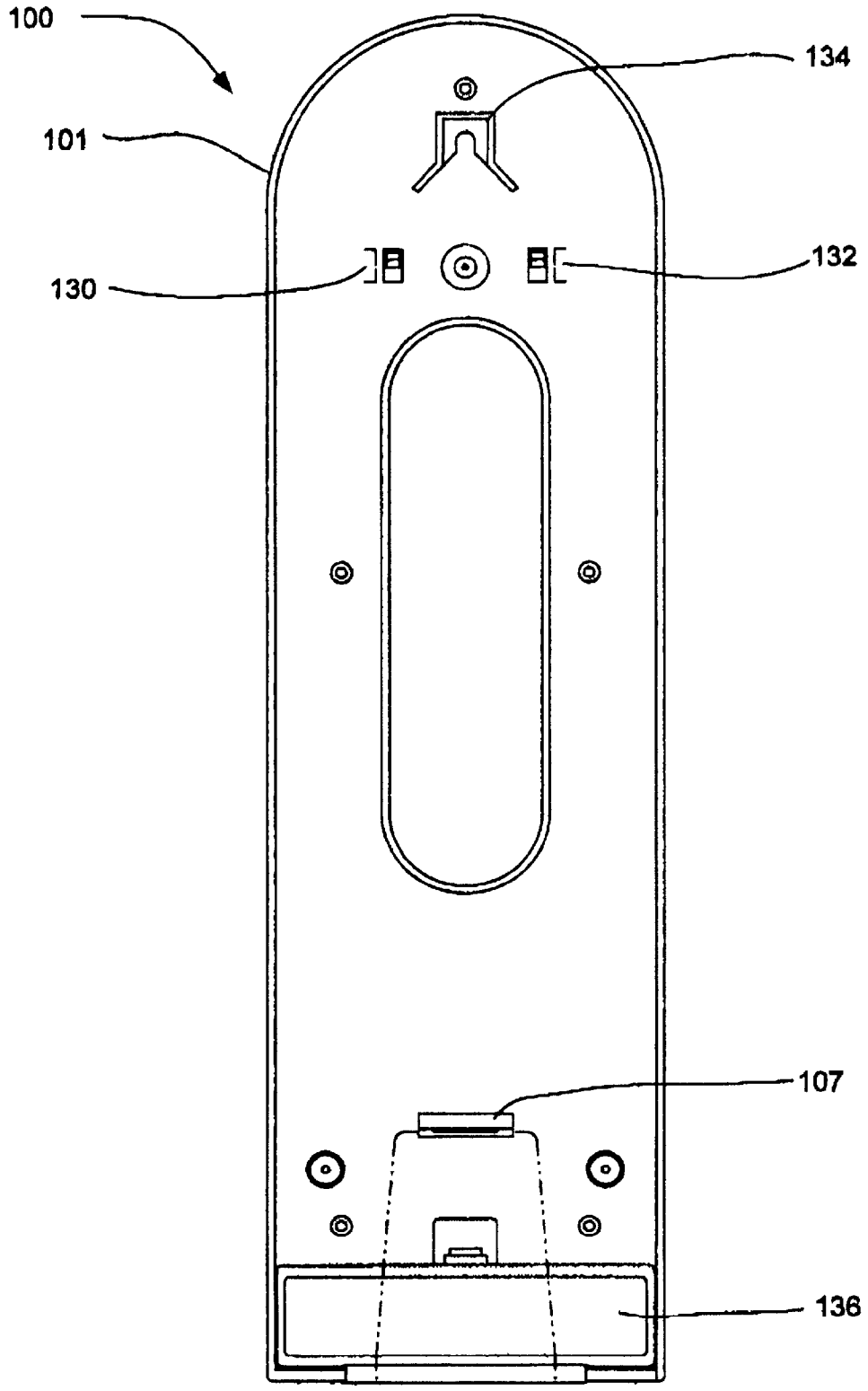
FIG. 2 is a rear view of an embodiment of the present invention.

The pill dispenser 100 (FIGS. 1, 2, 3) is used for storing and dispensing vitamins and pills. The pill dispenser 100 contains a housing 101, a removable front cover 102, a rotating belt 116, dividers 117 and a dispensing area 120. The housing 101 has a base 122 that provides support allowing the housing 101 to stand vertically when placed upon a flat surface. The base 122 also provides a platform for the cup 108 to sit upon. The cup 108 can be designed to be removable if desired. The housing 101 also has a hanger 134 on the back surface so that the dispenser 100 can be hung from a wall (see FIG. 2).

The pill dispenser 100 preferably has twenty-eight (28) individual compartments 124 for storing vitamin and/or pill servings. It can be appreciated that different numbers of compartments can be used depending upon the number of pills, or combinations of pills that are desired to be stored, and also depending upon the number of hours or days such storage and dispensing is desired. The compartments 124 are created by the dividers 117 that extend substantially perpendicular from the rotatable belt 116. As many individuals must ingest more than one pill or vitamin in a serving, each compartment 124 is large enough to hold several vitamins and/or pills.

The rotatable belt 116 is placed around a motor-driven drum and a second drum (both not shown) to provide tension within the belt 116. The belt 116 is preferably manufactured from a flexible plastic or rubber. Other materials such as metal may also be used. However, the belt 116 should be manufactured from a flexible material because the belt 116 must wrap around the motor-driven drum and the second drum.

Since the belt 116 is continuous, only one drum needs to have a motor to rotate the belt. The second drum only needs to provide tension and guidance. The pill dispenser may have two motor-driven drums, but the additional motor mechanism will add cost unnecessarily to the pill dispenser 100.

Preferably, the dividers 117 and the belt 116 are molded to form one piece. However, it is within the scope of the invention that the dividers 117 are connected with the belt 116. One of ordinary skill in the art will appreciate that the dividers 117 can be fastened in many different ways such as, but not limited to, a pin or adhesive. Any method of fastening whereby the divider 117 is rigid and extends substantially perpendicular from the belt 117 is acceptable.

The dispenser 100 has a removable front cover 102, allowing easy access to the compartments 124. To load the compartments 124, an individual can place the dispenser 100 on the back surface of the housing 101 so that the compartments 124 are facing upward. By removing the front cover 102, individual servings can be placed within each of the compartments 124. A complete individual serving should be placed within each compartment 124. By doing so, an individual will receive the complete serving he/she should take with one push of the control button 106. Another advantage of placing a complete serving in each compartment 124 is that an individual can load from several days to one month worth of servings at one time. For example, if an individual has three different regimens per day, nine days worth of servings can be loaded at one time. As the compartments 124 rotate in a single direction sequentially, the compartments 124 should be filled in the sequence that the regimens will be ingested.

An individual can program the pill dispenser 100 to customize the operation of the dispenser 100 to his or her specific regimen. The pill dispenser 100 should be programmed to remind the individual when it is time to take the next serving. The pill dispenser 100 has a four position slide switch 110 to set how many servings per day an individual will require (See FIG. 4). The four position slide switch 110 allows an individual to select from one to four servings per day.

The pill dispenser 100 can automatically calculate serving times based on the first serving time of the day. To set a timing schedule, first move the switch 118 to the "1$^{st}$ serving time set" position. To set the first serving-time of the day an individual may depress the hour button 114 and the minute button 112 to reach a specific time. The display 104 will show the time selected. Then, an individual must select the number of servings per day. The four position slide switch 110 allows an individual to select either 1, 2, 3 or 4 servings per day. By setting the switch 118 to the "run" position, the pill dispenser 100 will automatically calculate the serving time for the second, third and fourth servings of the day. For example, if an individual sets the first serving time for 8:00 a.m. and schedules four servings for the day, the timer will calculated subsequent serving times at 1:00 p.m., 6:00 p.m. and 11:00 p.m. Further examples are shown below in Table 1.

TABLE 1

| Number of Servings | Alarm Interval | First | Second | Third | Fourth |
|---|---|---|---|---|---|
| 1X | 24 hrs | 8:00 am | | | |
| 2X | 12 hrs | 8:00 am | 8:00 pm | | |
| 3X | 7 hrs | 8:00 am | 3:00 pm | 10:00 pm | |
| 4X | 5 hrs | 8:00 am | 1:00 pm | 6:00 pm | 11:00 pm |

The timer 200 (See FIG. 5) has an algorithm that calculates the serving times. Referring to Table 1 above, when an individual sets the switch 110 to one serving per day, the timer will calculate subsequent servings to be twenty-four hours apart. When the switch 110 is set to two servings per day, the timer will calculate the second serving to be twelve hours after the first serving. When the switch 110 is set to three servings a day, the timer 200 will calculate the subsequent servings to be seven hours apart. When the switch 110 is set to four servings per day, the timer 200 calculates the subsequent servings to be five hours apart.

The serving times can also be individually programmed. To set the first serving time, place the switch 110 to the first position and the switch 118 to "1$^{st}$ serving time set." Then, select the specific time by depressing the hour button 114 and the minute button 112. To set the second serving time, first place the switch 110 in the second position and then select the specific time by using the hour button 114 and the minute button 112. Repeat this procedure with the switch 110 in the third and fourth position to set the third and fourth serving time. Finally, place switch 118 back to the "run" position. By completing this process, the pill dispenser 100 will repeat the programmed serving times every day. Any serving time can be changed by placing the switch 110 to the specific serving time, the switch 118 to "clock set" and using the hour button 114 and the minute button 112.

Once the dispenser 100 is programmed, the dispenser 100 will notify the individual when it is time to ingest a serving. For example, the serving time and serving number on the display 104 will flash to indicate that it is time for a serving. In addition, a piezo-electric beeper 107 and/or LED 105 will activate at the same time. For example, if the pill dispenser 100 is set for three servings per day and the first serving is set at 8:00 am, an alarm will activate at 8:00 am, 3:00 pm and 10:00 pm. The pill dispenser 100 may be used without the LED reminder or the piezo-electric beeper 107 set and enabled. The back surface of the housing 101 has a beeper alarm on/off switch 130 and an LED on/off switch 132 (See FIG. 2). In addition, the back surface of the housing 101 has a battery compartment 136 and a wall mount 134.

Figure 5:
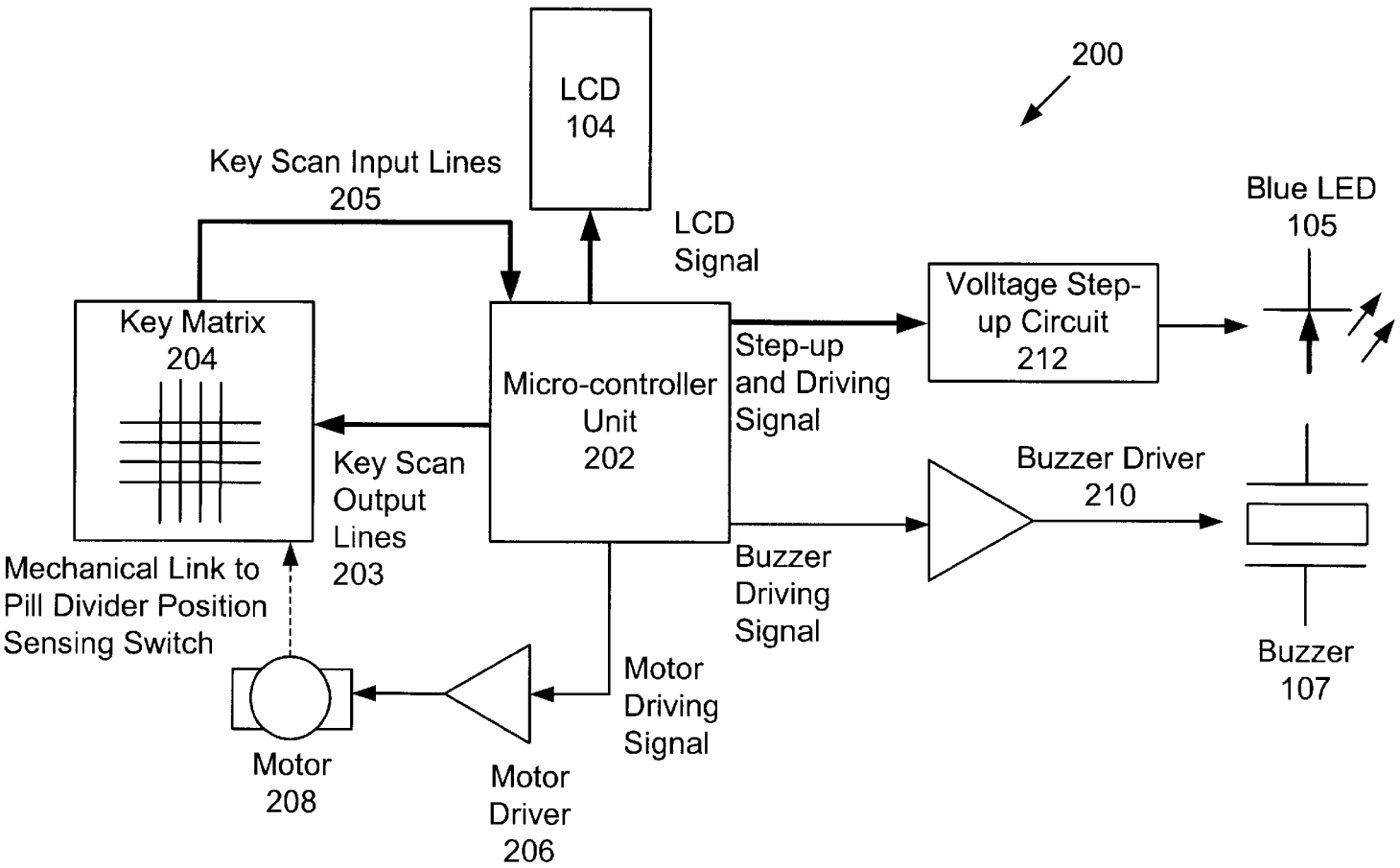
FIG. 5 is a schematic representation of an embodiment of the electronic circuitry of the invention.

When an individual is ready to take the next serving, manually activating the dispense control 106 will cause the rotating belt 116 to index forward one space, allowing the pills in the next compartment 124 to fall into the cup 108. The timer 200 controls the display 104, piezo-electric beeper 107 and LED 105. In this embodiment the timer does not automatically advance the rotating belt 116. Even when the timer 200 signals it is time for the next serving, the individual must activate the dispense control 106 to actuate the rotating belt 116 and dispense the serving contents into the cup 108. The cup 108 can then be removed from the dispenser 100. Alternatively, the timer 200 can be used to power a motor in order to drive the belt 116 to the next position. Further, a serving can be dispensed by sound. The sound-activated mechanism indexes the belt 116 one space so that the next serving can be dispensed. The motor that rotates the belt is connect with a similar circuit as shown in FIG. 5. For example, when an individual says "dispense" or claps after the programmed time, the belt 116 will index one space and dispense a serving.

Figure 4:
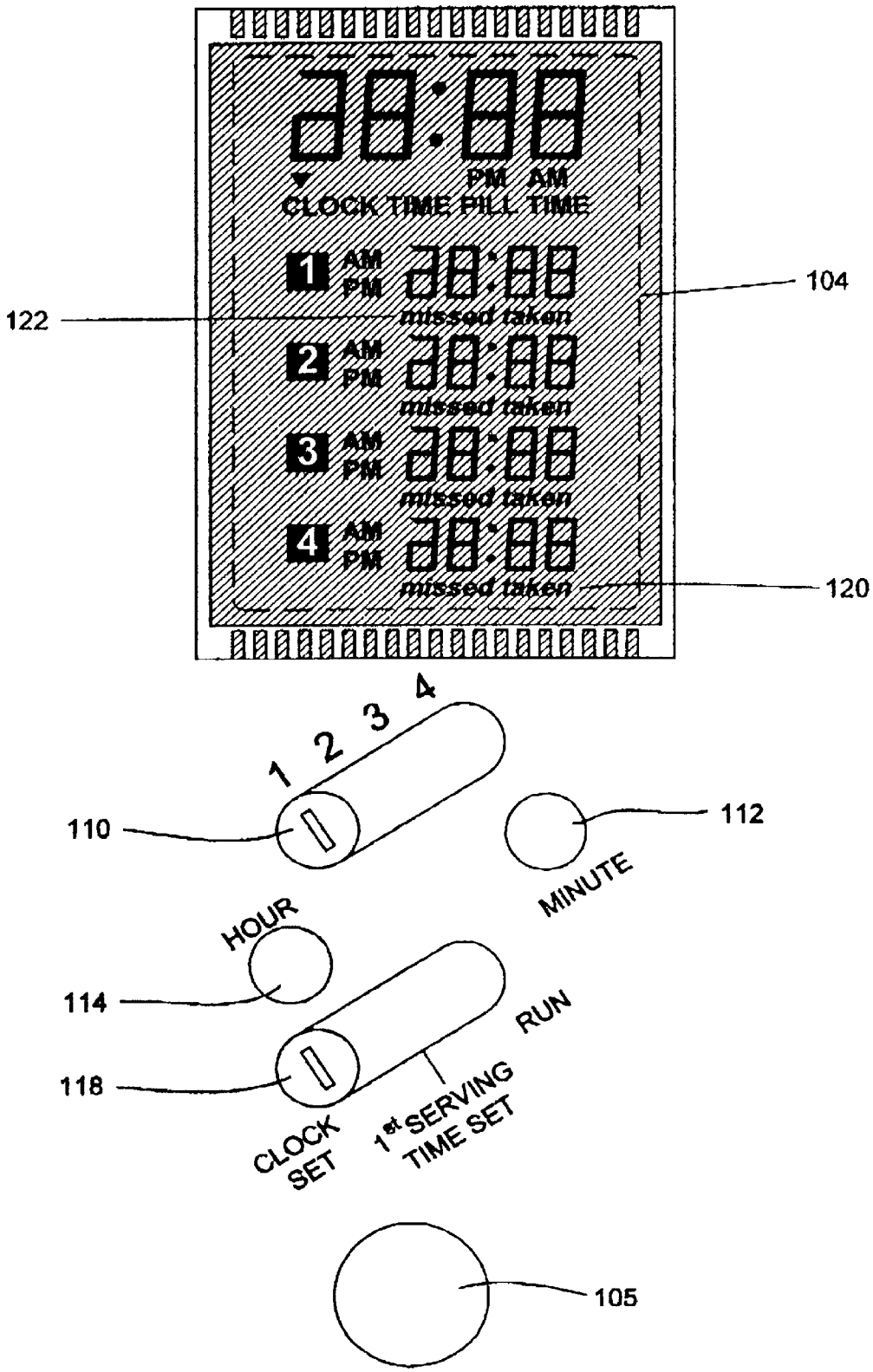
FIG. 4 is an enlarged front view of the display controls of the embodiment of FIG. 1.

After a serving is dispensed into the cup 108, the display 104 indicates that the serving has been dispensed with a "taken" indicator 120 (See FIG. 4). The "taken" indicator 120 will come on even if the pills are dispensed in advance of the prescribed time. For example, if an individual decides to dispense a serving into the cup 108 prior to a programmed serving time, the display 104 will flash "taken" at the programmed serving. To remind the individual that the serving was dispensed prior to the programmed serving time, the display 104 will flash "taken" until the appropriate prescribed time arrives, at which point the "taken" indicator 120 in the display 104 will remain steady. Conversely, if a serving is not dispensed within one hour of the prescribed time, the display 104 will flash a "missed" indicator 122.

Even if several serving times have been missed an individual can dispense the next serving. For example, if three programmed serving times have been missed, the display 104 will have three "missed" indicators 122 displayed. If an individual then attempts to dispense a serving after missing three servings, pressing the dispense control button 106 will dispense a serving and clear the first missed indicator 122. If there is also an older second, previously missed indicator 122 flashing, the next press of the dispense control button 106 will dispense another serving and clear the second "missed" indicator 122. Similarly, if a third serving is dispensed, the last "missed" indicator 122 will clear.

If an individual wishes to start the programmed serving schedule over, simply press the clear-all button 130 and all old "missed" indicators 122 and "taken" reminders 120 will be erased. The pill dispenser 100 will then assume that the individual is up to date and has taken all the servings at the programmed times. The pill dispenser 100 will then resume tracking the time from the current period, forgetting the past "missed" indicators 122 or "taken" indicators 120.

Figure 3:
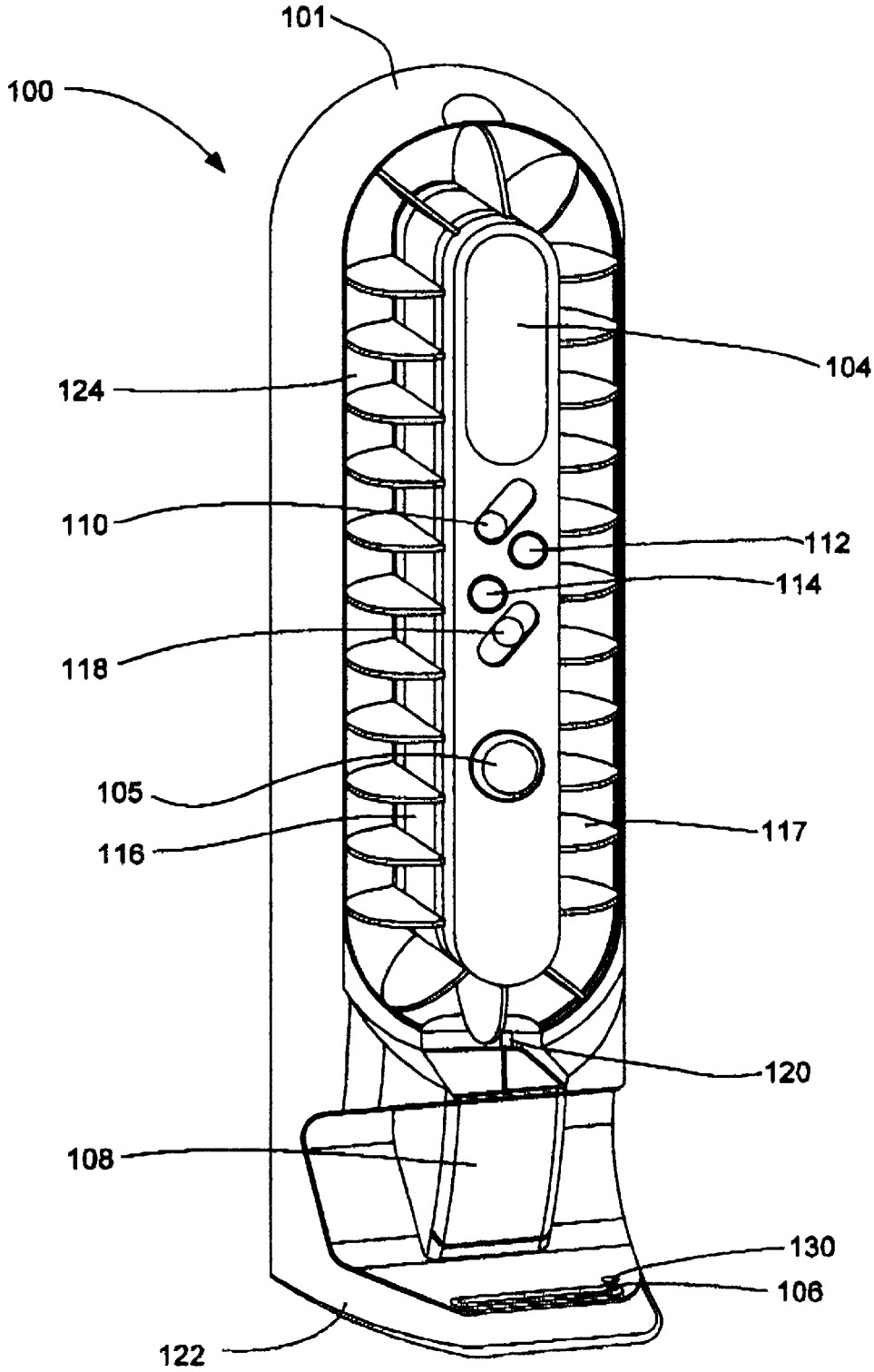
FIG. 3 is a perspective view of an embodiment of the present invention with the front cover removed to illustrate the individual compartments for storing the pills.

FIG. 3 depicts the pill dispenser 100 with the front cover 102 removed. With the cover 102 removed, the compartments 124 can be seen. As previously described above, each compartment 124 is defined by the boundaries of the rotating belt 116 and the dividers 117. One of ordinary skill in the art will appreciate that the belt 116 may rotate clockwise or counterclockwise upon pressing button 106.

When button 106 is pressed, the next successive compartment 124 will index forward to a position directly above the cup 108. The pill serving within the compartment 124 will drop into the cup 108. The cup 108 can be removed from the base 122 and the individual can then easily ingest the serving. After ingesting the serving, the cup 108 should be placed back into the base 122, directly below the compartment 124 that was just emptied. Otherwise, the next serving dispensed will drop into the base 122 and spill onto the surface that the pill dispenser 100 is set upon.

As previously mentioned above, an individual may refill all of the compartments 124 after the last compartment 124 has been emptied. However, one of ordinary skill in the art will appreciate that the empty compartments 124 maybe filled at any time. For example, even though only one-half of the compartments 124 are empty, an individual may set the pill dispenser 100 down horizontally, remove the front cover 102 and place a serving into each empty individual compartment 124. After refilling the empty compartments 124, simply replace the front cover 102 and set the pill dispenser 100 back on its base 122 or hang the pill dispenser 100 back on the wall.

FIG. 5 depicts a schematic block diagram or the control system 200 for the pill dispenser 100. A micro-controller unit 202 coordinates the various functions of the pill dispenser 100. As previously mentioned, an individual can program the specific times to take a dose or can simply input a "first dose" time and allow the pill dispenser 100 to calculate subsequent times. The times stored in and/or calculated by the pill dispenser 100 are stored in the micro-controller unit 202. The key matrix 204 functions as a register whereby the micro-controller unit 202 can check if the LED 105 or the buzzer 107 should be activated in addition to the indicator on the display 104.

For example, an individual can turn the buzzer 107 on or off via the alarm on/off switch 130. Similarly, the LED 105 can be turned on or off via the LED on/off switch 132. When the time arrives to take the next dosage, the micro-controller unit 202 send a signal to the key matrix 204 along the key scan output line 203. The registers in the key matrix 204 will indicate whether the LED 105 or the buzzer 107 should be activated by sending a signal back to the micro-controller unit 202 along the key scan input line 205. The micro-controller 202 will then generate a driving signal to either the voltage step-up circuit 212 or the buzzer driver 210. As shown in FIG. 5, the buzzer driver 210 will activate the buzzer 107, while the voltage step-up circuit 212 will activate the blue LED 105. The micro-controller 202 will not generate a motor driving signal to activate the motor driver 206 until the control button 106 is depressed. Upon pressing the control button 106, the micro-controller 202 will send a motor driving signal to the motor driver 206. The motor driver 206 will then activate the motor 208 and rotate the belt 116 forward one space, emptying the contents of compartment 124 into the cup 108. In another embodiment of the present invention, the micro-controller unit 202 will automatically send a signal to the motor driver 206 simultaneously as a signal is sent to the voltage step-up circuit 212 and/or the buzzer driver 210. Thus, a the selected time the belt 116 will rotate automatically to dispense a dosage into the cup 108.

The foregoing description of preferred embodiments of the present invention has been provided for the purposes of illustration and description. It is not intended to be exhaustive or to limit the invention to the precise forms disclosed. Many modifications and variations will be apparent to the practitioner skilled in the art. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. A device for storing articles comprising:

an elongated upstanding housing extending upwardly from a base, the housing having a cover;

a flexible belt within the elongated housing having dividers extending from the belt to define individual compartments adapted to store one or more articles wherein the flexible belt is formed into an elongated loop and defines a space within the elongated loop;

a dispensing compartment at the base of the housing located below the elongated loon wherein the articles stored in the compartments are selectively gravity fed into the dispensing compartment;

a dispensing control located in the space within the elongated loon that causes the flexible belt to advance in a direction to allow at least one article to be gravity fed from the individual compartment into the dispensing compartment; and wherein the flexible belt remains in the housing and the cover is removable to enable the articles to be plated placed in one or more of the individual compartments.

2. The device according to claim 1, wherein the rotating belt has 29 individual compartments.

3. The device according to claim 1, wherein a removable container sits within the dispensing area to contains the one or more articles that enters the dispensing area.

4. The device according to claim 1, wherein the housing is adapted so that the device may hang vertically on a wall.

5. The device according to claim 1, wherein the dispensing control is a button that must be depressed to index the rotating belt one space.

6. The device according to claim 1, wherein the dispensing control is sound activated, so that if a sound is detected above a minimum threshold the rotatable belt will index forward one space.

7. The device according to claim 1, wherein the housing is adapted so that the device may lie on a surface in a substantially vertical position.

8. The device according to claim 1, further comprising a programmable timer wherein the programmable timer automatically calculates serving times by a user moving a switch to a "first serving time" position, by a user setting the first serving time of the day by pressing an hour and minute button, and by a user selecting the number of servings per day.

9. The device according to claim 1, further comprising a display indicating a timing schedule wherein the display will further indicate that a serving has been missed by displaying a "missed" indicator.

10. The device according to claim 1, further comprising a display indicating a timing schedule wherein the display will further indicate that a serving has been taken by displaying a "taken" indicator.

11. A device for storing articles comprising:

an elongated upstanding housing extending upwardly from a base, the housing having a cover;

a flexible belt within the elongated housing having dividers extending from the belt to define individual compartments adapted to store one or more articles wherein the flexible belt is formed into an elongated loon and defines a space within the elongated loop;

a dispensing compartment at the base of the housing located below the elongated loop wherein the articles stored in the compartments are selectively gravity fed into the dispensing compartment;

a dispensing control located in the space within the elongated loop that causes the flexible belt to advance in a direction to allow at least one article to be gravity fed from the individual compartment into the dispensing compartment; and wherein the flexible belt remains in the housing and the cover is removable to enable the articles to be placed in one or more of the individual compartments without rotating the belt to a loading location.

12. The device according to claim 11, wherein the device has twenty-nine compartments, each compartment capable of storing the one or more articles.

13. The device according to claim 11, wherein a removable container sits within the dispensing area to contain the one or more articles that enters the dispensing area.

14. The device according to claim 11, further comprising a programmable timer wherein the programming means automatically calculates serving times by a user moving a switch to a "first serving time" position, by a user setting the first serving time of the day by pressing an hour and minute button, and by a user selecting the number of servings per day.

15. The device according to claim 11, further comprising a display indicating a timing schedule wherein the display will further indicate that a serving has been missed by displaying a "missed" indicator.

16. The device according to claim 11, further comprising a display indicating a timing schedule wherein the display will further indicate that a serving has been taken by displaying a "taken" indicator.

17. The device according to claim 11, wherein the housing is adapted so that the device may hang vertically on a wall.

18. The device according to claim 11, wherein the dispensing control is a button that must be depressed to index the rotating belt one space.

19. The device according to claim 11, wherein the dispensing control is sound activated, so that if a sound is detected above a minimum threshold the rotatable belt will index forward one space.

20. The device according to claim 11, wherein the housing is adapted so that the device may lie on a surface in a substantially vertical position.

21. A device for storing articles comprising:

an elongated upstanding housing extending upwardly from a base, the housing having a removable front cover;

a flexible belt within the elongated housing having dividers extending from the belt to define individual compartments adapted to store one or more articles, wherein the flexible belt is formed into an elongated loop and defines a space within the elongated loop;

a dispensing compartment at the base of the housing located below the elongated loop wherein the articles stored in the compartments are selectively gravity fed into the dispensing compartment;

a dispensing control that causes the flexible belt to advance in a direction to allow at least one article to be gravity fed from the individual compartment into the dispensing compartment; and wherein the flexible belt remains in the housing and the cover is removable to enable the articles to be placed in one or more of the individual compartments without rotating the belt to a loading location.

22. The device according to claim 21, wherein the housing is adapted so that the device may hang vertically on a wall.

23. The device according to claim 21, wherein a container is located within the dispensing area to hold the one or more articles after the one or more articles leaves the individual compartment.

24. The device according to claim 21, wherein the housing is adapted so that the device may stand on a surface in a substantially vertical position.

25. The device according to claim 21, wherein the dispensing control is a button that must be depressed to index the rotating belt one space.

26. The device according to claim 21, wherein the dispensing control is sound activated, so that if a sound is detected above a minimum threshold the rotatable belt will index forward one space.

27. The device according to claim 21, further comprising a programmable timer wherein the programmable timer automatically calculates serving times by a user moving a switch to a "first serving time" position, by a user setting the first serving time of the day by pressing an hour and minute button, and by a user selecting the number of servings per day.

28. The device according to claim 21, further comprising a display indicating a timing schedule wherein the display will further indicate that a serving has been missed by displaying a "missed" indicator.

29. The device according to claim 21, further comprising a display indicating a timing schedule wherein the display will further indicate that a serving has been taken by displaying a "taken" indicator.

* * * * *